US005848511A

United States Patent [19]

Scales

[11] Patent Number: 5,848,511

[45] Date of Patent: Dec. 15, 1998

[54] BLOCKS FOR CONSTRUCTING LOW-RISE ORNAMENTAL WALL AND METHOD

[76] Inventor: John M. Scales, 6347 Rosecommon Dr., Norcross, Ga. 30092

[21] Appl. No.: 785,386

[22] Filed: Jan. 21, 1997

[51] Int. Cl.[6] ..... E04C 1/00

[52] U.S. Cl. ..... 52/606; 52/608; 52/747.12; 405/286

[58] Field of Search ..... 52/604, 606, 608, 52/609, 747.12; 405/275, 284, 286; D25/114, 116

[56] References Cited

U.S. PATENT DOCUMENTS

| | | | |
|---|---|---|---|
| D. 295,788 | 5/1988 | Forsberg . | |
| D. 300,253 | 3/1989 | Forsberg . | |
| 534,462 | 2/1895 | Balsley . | |
| 1,795,451 | 3/1931 | Sharpe | 52/604 |
| 2,684,589 | 7/1954 | Perreton . | |
| 2,688,245 | 9/1954 | Vesper . | |
| 2,703,487 | 3/1955 | Ossoinack . | |

(List continued on next page.)

OTHER PUBLICATIONS

R&D Interlock International, Inc., London, Ontario, Canada brochure for Earthbase Dynoblock® Mortarless Self–Interlocking Concrete Units, 6pgs., 1989.

IDR (Innovative Design Research) Division of the National Concrete Masonry Association, Herndon, Virginia 22070 brochure for Terrastop™ Architectural Earth Retainage and Landscaping Wall System, 2 pgs., (undated).

Darmur® Retaining Walls brochure for dry–build concrete block wall from Square Grip, 6pgs., Sep. 1988.

Guttman Construction, Inc., San Diego, California 92108, brochure for EarthStone™ Wall System for erosion control, 2pgs., (undated).

Concor Technicrete Limited brochure for Enviro–Wall precast block retaining wall, 2pgs., (undated).

Versa–Lok™ brochure for retaining wall systems, 5pgs., Versa–Lok, Kiltie Corporation, North St. Paul, Minnesota 55109, (undated).

Designer Blocks, Inc. brochure for StoneWall™ Series System Landscape Retaining Wall System, 2pgs., Designer Blocks, Milwaukee, Wisconsin 53211, (undated).

*Primary Examiner*—Christopher Kent
*Assistant Examiner*—Timothy B. Kang
*Attorney, Agent, or Firm*—Kennedy, Davis & Kennedy

[57] ABSTRACT

A cast cementitious block for constructing a low-rise interconnected ornamental wall having a first course of the blocks placed side-by-side and a second course of the blocks stacked in side-by-side relation on the first course and off-set relative the first course. The blocks define a bottom surface and an opposing top surface, a front face and an opposing back face, and two opposing sides that each define side faces between the front face and the back face. The top surface defines a recessed cavity having an alignment point, and the block further defines a bore extending therethrough and open at the top surface and the bottom surface. The longitudinal axis of the bores of the blocks in the second course align with respective alignment points of the recessed cavities of the blocks in the first course. Adhesive fills the aligned recessed cavities and at least a portion of the respective bores. The adhesive cures to define rivets interconnecting the blocks in the first and the second courses. In another aspect, the side walls of a first block of the invention diverge outwardly at an obtuse angle to the front face and the side walls of a second block converge inwardly at an acute angle to the front face. The angles of convergence and divergence define supplementary angles. Low-rise ornamental walls assembled from the blocks and methods of assembling low-rise ornamental walls are disclosed.

36 Claims, 3 Drawing Sheets

U.S. PATENT DOCUMENTS

| | | | |
|---|---|---|---|
| 3,375,667 | 4/1968 | Hard . | |
| 3,430,403 | 3/1969 | Muse . | |
| 3,597,928 | 8/1971 | Pilaar . | |
| 4,031,678 | 6/1977 | Schuring . | |
| 4,123,881 | 11/1978 | Muse . | |
| 4,186,540 | 2/1980 | Mullins . | |
| 4,372,705 | 2/1983 | Atkinson . | |
| 4,436,447 | 3/1984 | Crowe . | |
| 4,449,847 | 5/1984 | Scales et al. . | |
| 4,465,398 | 8/1984 | Knudsen . | |
| 4,486,121 | 12/1984 | Thompson et al. . | |
| 4,592,675 | 6/1986 | Scales et al. . | |
| 4,813,812 | 3/1989 | Hasegawa et al. . | |
| 4,825,619 | 5/1989 | Forsberg | 52/609 X |
| 4,860,505 | 8/1989 | Bender | 405/286 |
| 5,031,376 | 7/1991 | Bender et al. | 52/609 |
| 5,161,918 | 11/1992 | Hodel | 52/606 X |
| 5,294,216 | 3/1994 | Sievert | 52/604 X |
| 5,417,523 | 5/1995 | Scales . | |
| 5,586,841 | 12/1996 | Anderson et al. | 52/606 X |
| 5,598,679 | 2/1997 | Orton et al. | 52/609 |
| 5,622,456 | 4/1997 | Risi et al. | 52/604 X |

BLOCKS FOR CONSTRUCTING LOW-RISE ORNAMENTAL WALL AND METHOD

TECHNICAL FIELD

The present invention relates to ornamental walls constructed by assembling tiers of interlocking blocks. More particularly, the present invention relates to cast blocks that interlock together after assembling into tiers of blocks to form an ornamental wall.

BACKGROUND OF THE INVENTION

Stone blocks have been used for a number of years to assemble walls of various types, including ornamental walls for landscaping purposes. Generally, such low-rise walls are at most several feet in height and are not relied upon to retain earth backfill from movement. Rather, such walls define an ornamental facing to a low-rise elevation of earth or comprise a low-rise free standing wall, such as along a driveway or ornamental wall in a lawn landscape.

Many of these types of walls have been assembled from blocks or stones cut from quarries. While the blocks have substantially the same dimensions, stones cut from quarries actually have unique sizes, differences in shape, and differences in appearance. Construction of walls using such blocks requires significant skilled labor to match, align, and place blocks so that the wall is erected with substantially uniform tiers. A tier is one of two or more rows or ranks of blocks arranged one above another. The tiers define a course, row, or layer of blocks forming a substantially continuous, level or range of blocks throughout a wall. Generally, mortar and grout fill-in the cavities and the variations in the dimensions of the blocks to provide a substantially uniform arrangement of tiers in the wall. Often the mass of the blocks is relied upon to maintain the blocks together in the wall.

While such low-rise stone walls provide an attractive ornamental appearance to landscaping, the cost of the quarried stone and the labor to assemble the stone blocks to make such walls are generally cost prohibitive for use in home and small business landscapings. Accordingly, such ornamental walls have also been constructed from cast cementitious blocks. In addition to reducing the cost, the cast blocks provide a uniform size and shape. Typically the blocks define shapes which permit physical interlocking of one block with vertically adjacent blocks or the blocks are joined together by pins that extend between adjacent courses in the wall. Some walls have blocks that are mortared together, or rely on the mass of the blocks to maintain the blocks together.

Cast blocks generally define bodies having top, bottom, front, back, and side faces. The side faces of such blocks typically are substantially perpendicular to the front and back faces. While many ornamental walls constructed of such blocks form substantially straight lines, there is a need often to have the wall track a curving line. In such, adjacent blocks touch at least on the front edges. This however leaves V-shaped spaces on the back side of the wall. Select fill, such as stone and granular material, is used to fill-in the spaces of the wall. Such fill is expensive and labor intensive to place.

While cast blocks have reduced the cost of assembling the walls, these structures generally remain prohibitively expensive and difficult for use in assembling low-rise ornamental walls for landscaping around homes and businesses. Accordingly, there is a need in the art for improved cast blocks for assembling low-rise ornamental walls. It is to such that the present invention is directed.

SUMMARY OF THE INVENTION

The present invention overcomes the problems of the prior art by providing a cast cementitious block for constructing a low-rise ornamental wall of a plurality of interconnected blocks. The wall has a first course of the blocks placed side-by-side and a second course of the blocks stacked in side-by-side relation on the first course and off-set relative said first course to define an alternating pattern of blocks. The first and second courses, or tiers, are thereafter interconnected together, before a subsequent tier of blocks is placed in the wall and secured to the adjacent lower tier. Each of the cast cementitious blocks has a bottom surface and an opposing top surface, a front face and an opposing back face, and two opposing sides that each define side faces between the front face and the back face. The top surface defines a recessed cavity having an alignment point, and the block further defines a bore extending through the block. The bore is open at the top surface and the bottom surface and defines a longitudinal axis. The central point of the recessed cavity and the longitudinal axis are substantially equally spaced from a front edge of the top surface and substantially equally spaced on opposing sides and laterally of a perpendicular line that defines a plane which bisects the front face. The longitudinal axis of the bores of the blocks in the second course substantially align with the respective alignment points of the recessed cavities of the blocks in the first course. Adhesive communicates through each of the bores to fill the aligned recessed cavity and at least a portion of the bore. The adhesive cures to define rivets interconnecting the blocks in the second course and in the first course. Additional courses, or tiers, can be stacked and joined to respective vertically lower tiers.

In another aspect, the present invention provides a low-rise decorative wall for landscaping ornamentation assembled with the blocks described above. The wall includes a first tier of blocks placed side-by-side and a second tier of blocks placed side-by-side on an upper surface of the first tier of blocks. The blocks in the second tier are off-set relative to the blocks in the first tier, whereby the side edges of the blocks in the second tier are aligned medial the side edges of a pair of blocks in the vertically lower first tier. The longitudinal axes of the bores of the blocks positioned in the second course substantially align with the respective alignment points of the recessed cavities in the first course. An adhesive fills at least a portion of the bores and the aligned recessed cavities. The adhesive cures to define rivets interconnecting the blocks of the second course and the blocks in the first course.

The present invention further provides a method of assembling a low-rise ornamental wall from a plurality of the blocks described above, comprising placing a plurality of the blocks side-by-side in a course of the blocks to define a first tier of a wall. A plurality of the blocks are then placed side-by-side in a second course to define a second tier in a wall of the blocks. The second tier of blocks is off-set substantially one-half width of a block, whereby the longitudinal axis of the bores of the blocks in the second tier substantially align with respective alignment points of the recessed cavities of the blocks in the first tier. An adhesive is communicated through the bores to fill the aligned recessed cavities in the first tier and at least a portion of the bores in the second tier. The blocks are thereby joined together by the adhesive which cures to define rivets interconnecting the blocks in the first and second tiers.

In another aspect, the present invention provides a pair of cast cementitious blocks for constructing a low-rise ornamental wall with a plurality of said blocks. The wall has a first course of pairs of blocks placed side-by-side and at least a second course of pairs of blocks stacked in side-by-side relations on the first course. Each block comprises a cast cementitious body having a bottom surface and an opposing top surface, a front face and an opposing back face, and two opposing sides that each define said faces between said front face and said back face. The two opposing side walls in a first block of the pair of blocks diverge outwardly from the front face to the back face at an obtuse angle relative to the front face. The two opposing side faces in a second block of the pair of blocks converge inwardly from the front face to the back face at an acute angle relative to the front face. The angles of divergence and convergence of the side walls of the first and second blocks are substantially supplementary, whereby the pair of blocks, being positioned side-by-side, define a substantially straight line.

A plurality of the blocks of the present invention described above form a low-rise decorative wall for landscape ornamentation. The pairs of blocks are aligned side-by-side in tiers to a predetermined height for the wall. The angles of divergence and convergence of the side faces are substantially supplementary, whereby the pairs of blocks, being positioned side-by-side in the courses of blocks to form a low-rise ornamental wall, define a substantially planar surface for the wall.

In another aspect, the present invention provides a method of assembling a low-rise ornamental wall from a plurality of pairs or blocks discussed above. The method places a plurality of pairs of the blocks side-by-side in courses of the blocks. The angles of divergence and convergence of the side walls in the first and second blocks are substantially supplementary, whereby the pairs of blocks, being positioned side-by-side in the courses, define a substantially planar surface for the wall. Additional pairs of blocks are placed in vertically higher courses until a predetermined height is reached by a last course.

Objects, advantages and features of the present invention will become apparent from a reading of the following detailed description of the invention and claims in view of the appended drawings.

DETAILED DESCRIPTION OF THE PREFERRED EMBODIMENT

Figure 1:
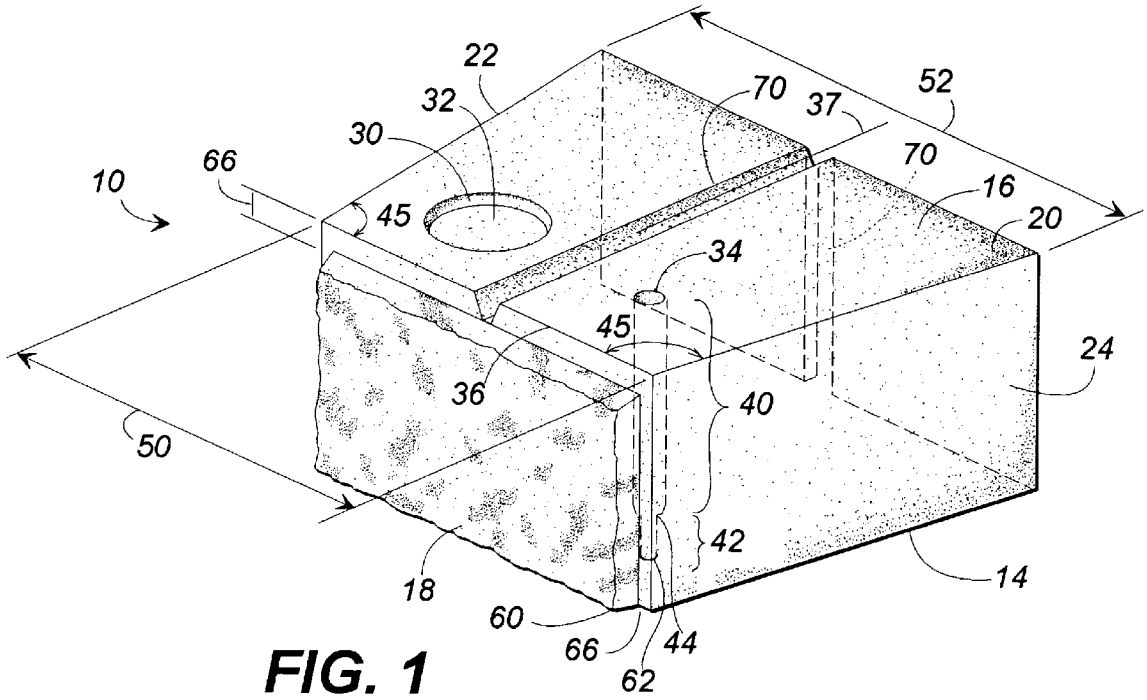
FIG. 1 is a perspective view of a first block according to the present invention.
Figure 2:
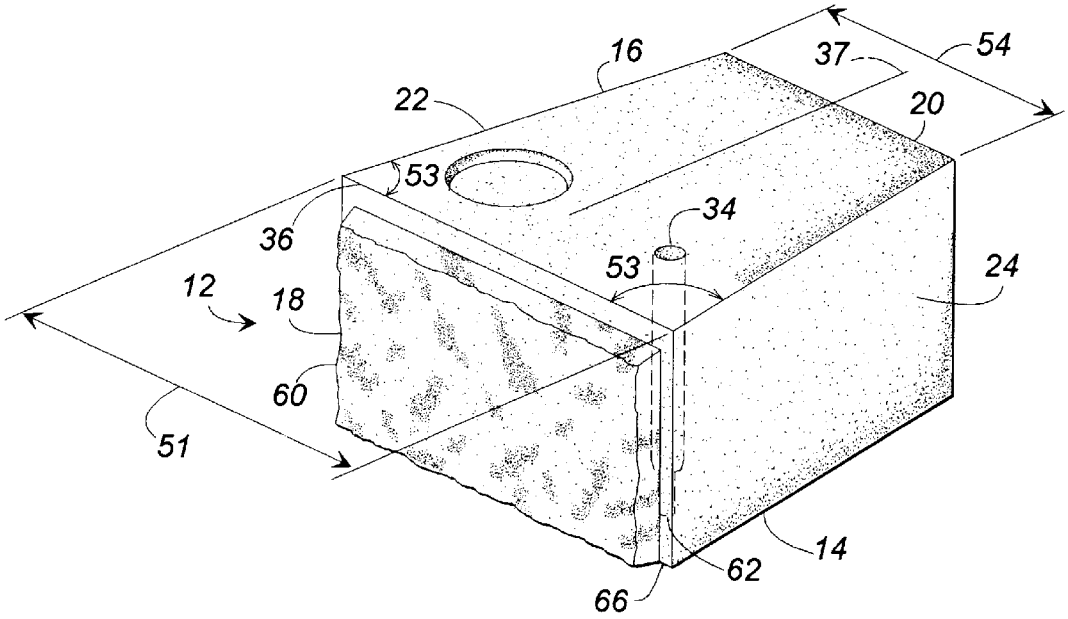
FIG. 2 is a perspective view of a second block according to the present invention.
Figure 3:
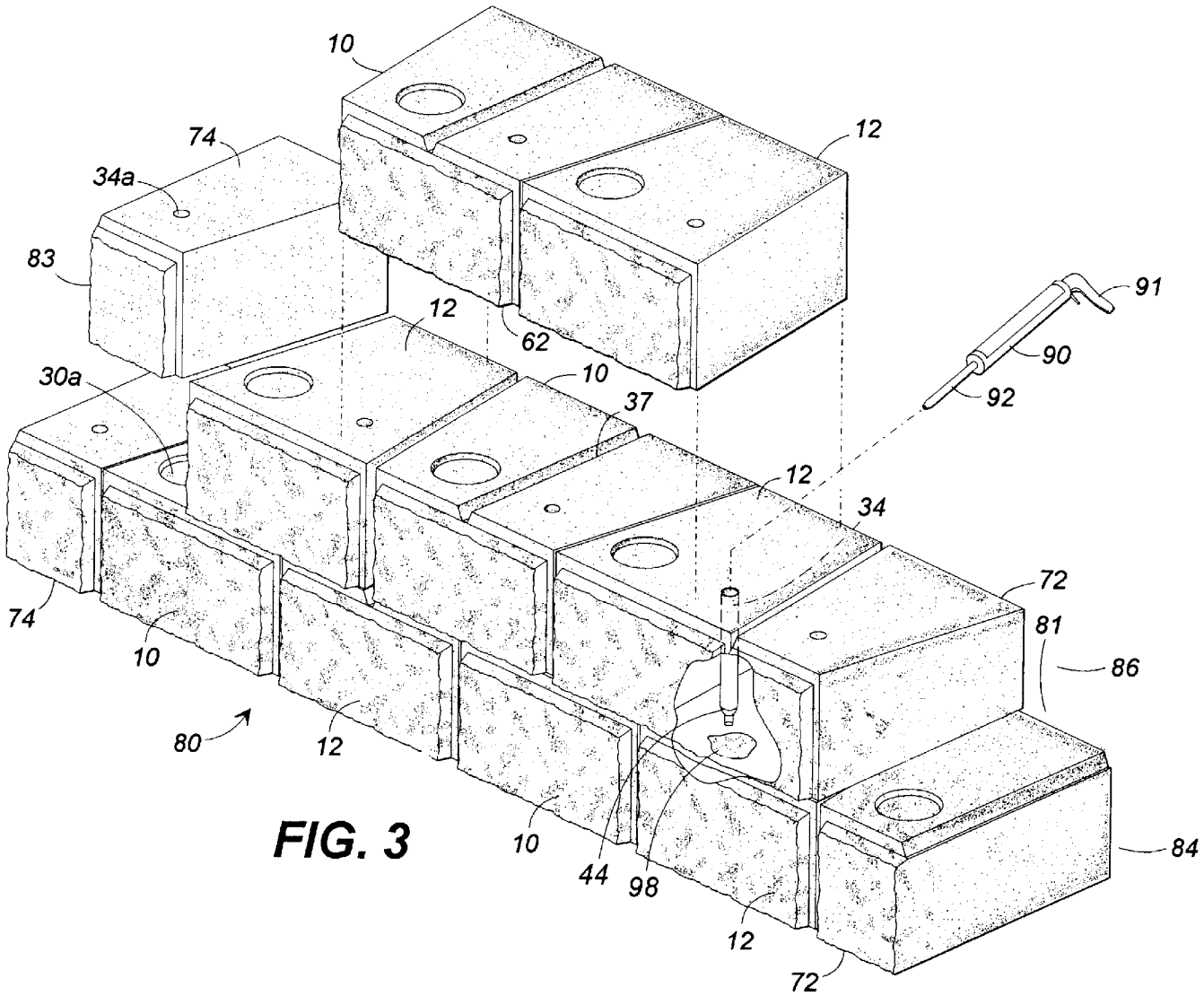
FIG. 3 is a perspective, exploded view of a low-rise ornamental wall assembled from a plurality of blocks illustrated in FIGS. 1 and 2 in a stepped-tier placement, with a partially cut-away portion to illustrate the rivet that connects blocks in adjacent tiers.

Referring now in more detail to the drawings, in which like numerals indicate like parts throughout the several views, FIGS. 1 and 2 illustrate perspective views of a first block 10 and a second block 12 according to the present invention. A plurality of the blocks 10 and the blocks 12 are positioned in tiers of blocks to form a low-rise ornamental wall as best illustrated in FIG. 3. Each of the blocks 10 and 12 define bodies having a bottom surface 14 and an opposing top surface 16, a front face 18 and an opposing back face 20, and two opposing sides 22 and 24 that each define sides between the front face 18 and the back face 20.

The top surface 16 defines a recessed cavity 30 having an alignment point 32. In the illustrated embodiment, the recessed cavity is a circular dish defining a shallow recess in the blocks 10, 12. The alignment point 32 is the center of the circular cavity. The blocks 10, 12 each further define a bore 34 that extends through the block. The bore 34 is open at both the top surface 16 and the bottom surface 14. The bore 34 defines a longitudinal axis. The alignment point 32 of the recessed cavity 30 and the longitudinal axis of the bore 34 are substantially equally spaced from a front edge 36 defined by the top surface 16 and the front face 18. Further, the alignment point 32 and the longitudinal axis of the bore 34 are substantially equally spaced from and on respective opposite sides of a perpendicular line 37 which defines a plane bisecting the front face 18.

In the illustrated embodiment, the bore 34 defines a first portion 40 and a second portion 42. The first portion 40 occupies most of the length of the bore 34. The first portion 40 has a first diameter. The second portion 42 defines a smaller length of the bore 34 and has a second diameter smaller than the first diameter. The junction face 44 between the first portion 40 and the second portion 42 defines a stop for a purpose discussed below.

In the illustrated embodiment, the faces 22 and 24 of the block 10 are oriented at an obtuse angle 45 relative to the front face, whereby the sides diverge outwardly through the thickness of the block from the front face 18 to the back face 20. Accordingly, in block 10, the front face 18 has a first width 50 and the back face 20 has a second width 52 that is greater than the width 50 of the front face. In contrast, the side faces 22 and 24 in the block 12 are oriented at an acute angle 53 relative to the front face 18, whereby the side faces converge inwardly through the thickness of the block from the front face 18 to the back face 20. The width 51 of the front face 18 in the block 12 is the same as the width 50 in the front face of the block 10. However, the width 54 of the back face 20 in the block 12 is less than the width 50 because of the converging angle of the side faces 22 and 24.

In a preferred embodiment, the angle of convergence and divergence of the respective walls 22, 24 in the blocks 10 and 12 define supplementary angles. This facilitates placing the blocks 10, 12 alternating side-by-side in a straight line that defines the track of the wall. Further, the use of angled side faces 22, 24 facilitates use of the blocks 10, 12 for tracking radius lines for curving embodiment of the ornamental wall, as discussed below. In the illustrated embodiment, the width 50 is 8.9375 inches. The distance between the front face 18 and the back face is 9.0 inches. The blocks each have heights of 4.0 inches. The front face 18 extends 0.5 inches from the edge 36 and an upper edge of the front face 18 is recessed 0.375 inches below the upper surface 20. The cavity 30 is preferably an annular dish having an overall diameter of 2.375 inches and a beveled perimeter defining a recessed floor having a diameter of 2.125 inches. The alignment point 32 defining the center of the dish 30 is spaced 4.5 inches from the longitudinal axis of the bore 34.

The front face 18 of the blocks 10, 12 defines a projecting contour surface 60 in order for the blocks to simulate the appearance of hand-hewn stone blocks. The side and upper edges of the contour surface 60 are spaced-apart, or recessed, from the respective opposing side edges 62 of the front face 18 and from the upper edge 36 of the front face. This spacing between the edges of the outwardly extended surface 60 and the edges of the blocks defines gaps 66 between the edges of the contour surface 60 and the side and upper edges 62, 36 of the front face. These gaps 66 simulate mortar joints when the blocks 10, 12 are stacked side-by-side in tiers to form a wall, as discussed below.

With reference to FIG. 1, the upper surface 16 in a preferred embodiment of the block 10 further defines a channel 70 along the line 37. The channel 70 also preferably extends from the top surface 16 to the bottom surface 14 in the back face 20. The channel 70 is substantially v-shaped and defines a groove, or split line, for bisecting the block 10 into half-blocks 72, 74. The block 10 is bisected in order to define half-blocks for mating placement at ends of the tiers of blocks, so that the end of the wall constructed with the blocks has substantially planer faces on the sides, as discussed below. The block 10 is split using a conventional hammer and chisel.

Figure 6:
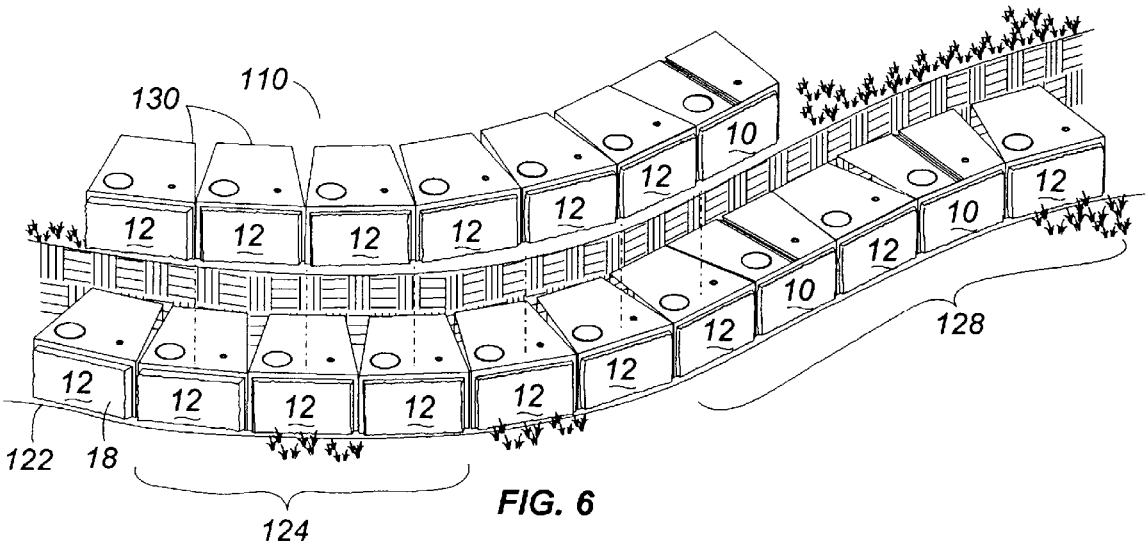
FIG. 6 is a perspective view of a low-rise curving ornamental wall assembled from a plurality of blocks illustrated in FIGS. 1 and 2.

FIG. 3 illustrates a low-rise decorative wall 80 for landscape ornamentation, for example, along a side of a driveway. The wall 80 comprises a first tier 84 of blocks 10, 12 placed alternately side-by-side. The alternating sequence of blocks 10, 12 place the divergent and convergent side walls 22, 24 of the alternating blocks 10, 12 in adjacent juxtaposition so that the face of the wall 80 tracks a line. With reference to FIG. 6 and in a view relative to the faces 18 of the blocks, an inwardly curving radius 128 is defined by pairs of blocks 10 and 12 positioned adjacent side-by-side but at least touching at the respective front side edges 62. For an outwardly curving radius 124, blocks 12 are positioned adjacent side-by-side but touching at the front side edges 62 of the blocks.

With continued reference to FIG. 3, a second tier 86 of blocks 12, 10 is placed side-by-side on an upper surface of the first tier 84 of the blocks. The blocks 12, 10 in the second tier 86 are off-set one-half of the width of the front face 18 relative to the blocks 10, 12 in the first tier 84. The side edges 62 of the adjacent blocks 12, 10 in the second tier 86 align with the centerline of the block vertically below; for example, with a respective line 37 of the block 10 vertically below in the first tier 84. Accordingly, the off-set defines a one-half width step for the tiers 84, 86 to define an alternating pattern of blocks in the wall 80. The off-set substantially aligns the alignment point 32 of the recessed cavities 30 in the first tier 84 with the longitudinal axis of the bore 34 in the second tier 86.

In constructing the wall 80, the blocks 10, 12 in the first tier 84 are positioned alternately side-by-side along a line defining the face edge of the ornamental wall. The blocks 12, 10 forming the second tier 86 are then positioned in off-set, step relation to the first tier 84 as discussed above.

The side ends 81, 83 of the wall 80 define respective stepped faces by positioning half-blocks 72, 74 at the respective ends of each tier. The half-blocks 72, 74 are formed by splitting one block 10 along the split line 37 by striking the block with a hammer and chisel. As illustrated, half-blocks 72 containing the recess cavity 30 are positioned in the tiers 84 and 86 adjacent one of the blocks 12. This provides a stepped right side face 81 for the wall 80. Similarly, half-blocks 74 containing the bore 34 are positioned in the tiers 84 and 86 adjacent ones of the blocks 12 and above ones of the blocks 10. The bore 34*a* in the half-block 74 in the second tier 86 aligns with the recess cavity 30*a* in the block 10 in the first tier 84. This provides a stepped left side face 83 for the wall 80.

Once the second tier 86 is in position, the first and second tiers 84, 86 of the blocks 10, 12 are then interconnected together. Adhesive is communicated through the bores 34 to fill the aligned recess cavities 30 and a portion of the bores. The adhesive cures to form rivets interconnecting vertically adjacent tiers and the adhesive filling the recess cavities 30 bonds the top surfaces 16 of blocks 10, 12 in the vertically lower tier 84 to the bottom surfaces 14 of the blocks in the vertically higher tier 86. This is accomplished preferably by discharging the adhesive from a tube 90 having an elongated discharge nozzle 92. Such tubes with adhesive are conventionally available commercially. The tube 90 is received in a conventional ratchet-driven, gun-style caulk gun 93. The adhesive can be a two-part epoxy. The nozzle 92 is slidingly received within the bore 34. The stop 44 in the bore 34 holds a tip end of the nozzle 92 spaced-apart from the cavity 30. The plunger on the gun 93 is operated to dispense the adhesive from the tube 90 through the nozzle 92 into the recessed cavity 30 and at least a portion of the bore 34. This is repeated for each of the bores 34 in the second tier 86 in order to fill the respective receiving cavities 30 and portions of the bores 34 with adhesive.

The adhesive cures to define rivets 98 which interconnect the blocks 10, 12 in the second tier 86 with the blocks 10, 12 in the first tier 84. The adhesive also bonds the adjacent top surfaces 16 and bottom surfaces 14 of the blocks 10, 12 in the adjacent tiers 84, 86. The end blocks 72, 74 can be secured to the adjacent blocks 10, 12 with adhesive applied to aligned side faces. The end blocks 74 include the bore 34, so the blocks 74 can be also connected with adhesive rivets to the vertically adjacent blocks below. A sheet of a filter-fabric or drainage fabric can be positioned against the back face of the wall to prevent soil from washing through joints of adjacent blocks.

Additional courses 84 and 86 are stacked in off-set stepped relation until reaching a predetermined height for the wall.

While placement of the blocks 10, 12 as described above aligns the bores 34 with the respective alignment points 32 in the recess cavities 30, exact alignment is not necessary. The sizes of the bores 34 and the recess cavities 30 provide sufficient overlap of alignment so that the adhesive communicates into the cavity even though the bore and the alignment point are not precisely aligned. Such flexibility of alignment facilitates use of the blocks 10, 12 in tracking a curved line for the ornamental wall 80.

Figure 4:
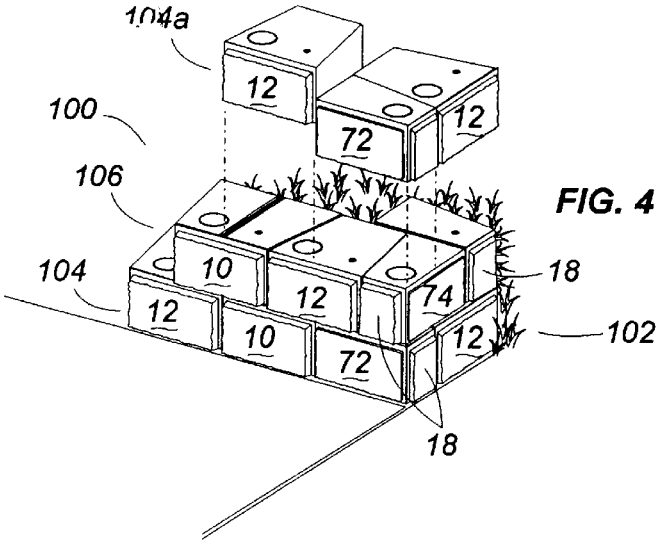
FIG. 4 is a perspective, exploded partial view of a low-rise ornamental wall assembled from a plurality of blocks illustrated in FIGS. 1 and 2, with a vertically stacked end construction.
Figure 5:
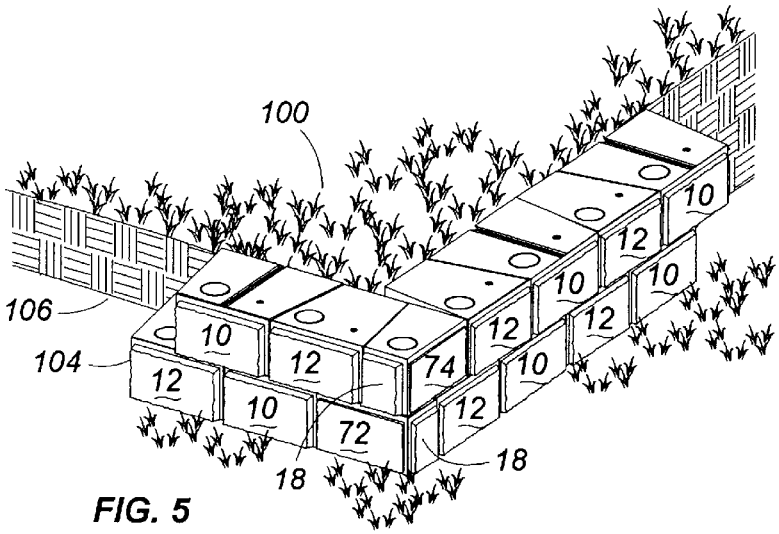
FIG. 5 is a perspective, exploded partial view of a low-rise ornamental wall assembled from a plurality of blocks illustrated in FIGS. 1 and 2, to illustrate corner construction for a wall.

FIG. 4 is a perspective, exploded of a low-rise ornamental wall 100 assembled from a plurality of blocks 10, 12 illustrated in FIGS. 1 and 2, having vertically stacked end construction generally designated 102 comprising half blocks 74 and 72 split from blocks 10. The illustrated embodiment shows a first course 104, a second course 106 and a third course 104*a* which is a repeat of the course 104. The end of the course 104 is defined by one of the half blocks 72 and an adjacent one of the blocks 12. The end of the second course 106 is defined by one of the half blocks 74 and one of the half blocks 72. The courses 104 and 106 repeat for the height of the wall 100. Should it be desired that the wall 100 continued past the corner, the half block 72 in the course 106 would be replaced with a convergent block 12, as illustrated in FIG. 5. The wall continues with alternating blocks 10, 12.

FIG. 6 is an exploded perspective view of an ornamental wall 110 which tracks a curved line generally designated 122. Relative to the front face 18 of the blocks 10, 12, the line 122 defines a convex arcuate portion 124 which curves outwardly. The line 122 further defines a concave portion 128 which curves inwardly. In the convex arcuate portion 124, the convergent blocks 12 are positioned side-by-side with the face edges 62 touching. In the concave arcuate portion 128, alternating combinations of blocks 10, 12 are used with at least the face edges 62 of adjacent blocks 10, 12 in contact. Slight gaps 130 between blocks can be filled with select fill, as necessary.

In an alternate embodiment of the present invention, the blocks do not include the recess 30 and the bore 34. The low-rise ornamental walls are assembled using the blocks 10, 12 placed in alternating sequence, as discussed above. The blocks 10, 12 in adjacent courses or tiers are joined together by adhesive placed on the upper surfaces of the blocks prior to placing the subsequent vertically higher tier. In this embodiment, the blocks 10, 12 in one course can be offset, or not, relative to the adjacent course.

It is thus seen that the present invention provides an easily constructed low-rise ornamental wall. The principles, preferred embodiments, and modes of operation of the present invention have been described in the foregoing specification. The invention is not to be construed as limited to the particular forms disclosed because these are regarded as illustrative rather than restrictive. Moreover, variations and changes may be made by those skilled in the art without departure from the spirit of the invention as described by the following claims.

What is claimed is:

1. A cast cementitious block for constructing a low-rise interconnected wall of a plurality of said blocks, said wall having a first course of said blocks placed side-by-side and a second course of said blocks stacked in side-by-side relation on said first course and offset relative said first course, comprising:

a cast cementitious block having a bottom surface and an opposing top surface, a front face and an opposing back face, and two opposing sides that each define side faces between said front face and said back face;

said top surface defining a shallow dished recessed cavity for receiving adhesive and having an alignment point, and said block further defining a bore extending therethrough and open at said top surface and said bottom surface, said bore defining a longitudinal axis therein; and said alignment point of said recessed cavity and said longitudinal axis being substantially equally spaced from a front edge of said top surface and substantially equally spaced laterally from a line bisecting said front face, whereby said longitudinal axis of said bores of said blocks positioned in said second course substantially align with respective alignment points of said recessed cavities of said blocks in said first course, said bore for receiving an adhesive which fills said aligned shallow dished recessed cavity and at least a portion of said bore, said adhesive being curable to define rivets in situ interconnecting said blocks in said second course and said blocks in said first course.

2. The block as recited in claim 1, wherein said two opposing sides diverge outwardly from said front face of said block to said back face.

3. The block as recited in claim 1, wherein said opposing sides of said block converge inwardly from said front face of said block to said back face.

4. The block as recited in claim 1, wherein said top surface further defines a channel extending from a back edge to said front edge along said line bisecting said front face, whereby said channel defines a guide for dividing said block into halves to provide one half of said block that matingly stacks in said courses at their ends for defining a planer end face or corner of said wall.

5. The block as recited in claim 4, wherein said channel is substantially v-shaped.

6. The block as recited in claim 1, wherein said recessed cavity is circular.

7. The block as recited in claim 1, wherein said front face defines a projecting contour surface, whereby said block simulates the appearance of hand-hewn stone blocks.

8. The block as recited in claim 7, wherein said contour surface is recessed from opposing side edges of said front face and from an upper edge of said front face, whereby said recess define gaps which simulate a mortar joint between adjacent ones of said blocks.

9. The block as recited in claim 1, wherein said bore defines a first portion having a first diameter and a second portion having a second smaller diameter being positioned in a lower portion of said block, whereby a transition between said first portion and said second portion defines a stop for a nozzle of a tube of adhesive received in said bore for filling said recessed cavity and at least a portion of said bore with said adhesive.

10. A pair of cast cementitious blocks for constructing a low-rise interconnected wall with a plurality of said blocks, said wall having a first course of said pairs of blocks placed side-by-side and a second course of said pairs of blocks stacked in side-by-side relation on said first course and offset relative to said first course, each block of said pair of blocks comprising a cast cementitious body having a bottom surface and an opposing top surface, a front face and an opposing back face, and two opposing sides that each define side faces between said front face and said back face;

in a first block of said pair of blocks, said two opposing sides thereof diverge outwardly from said front face to said back face at an obtuse acute relative to said front face; and in a second block of said pair of blocks, said opposing sides thereof converge inwardly from said front face to said back face thereof at an acute angle relative to said front face, said angles of divergence and convergence of said side walls being substantially supplementary, whereby said pair of blocks, being positioned side-by-side, define a substantially straight line along the face of said pair of blocks;

said top surface in each said block defines a dished, recessed cavity for filling with an adhesive and having an alignment point;

each said block further defines a bore extending therethrough and open at said top surface and said bottom surface, said bore defining a longitudinal axis therein, said alignment point of said dished recessed cavity and said longitudinal axis being substantially equally spaced from a front edge of said top surface and substantially equally spaced laterally from a line bisecting said front face, whereby said longitudinal axis of said bores of said blocks positioned in said second course substantially align with respective alignment points of said recessed cavities of said blocks in said first course, said bore for receiving an adhesive which fills said aligned dished recessed cavity and at least a portion of said bore, said adhesive being curable to define rivets in situ interconnecting said blocks in said second course and said blocks in said first course.

11. The pair of blocks as recited in claim 10, wherein said recessed cavity is circular.

12. The pair of blocks as recited in claim 10, wherein said bore defines a first portion having a first diameter and a second portion having a second smaller diameter in a lower portion of said block, whereby a transition between said first portion and said second portion defines a stop for a nozzle of a tube of adhesive received in said bore for filling said recessed cavity and at least a portion of said bore with said adhesive.

13. The pair of blocks as recited in claim 10, wherein said top surface in said first block further defines a channel extending from a back edge to said front edge along a perpendicular line bisecting said front face, whereby said channel defines a guide for dividing said block into halves to provide one half of said block that matingly stacks in said courses at their ends for defining a planer end face or corner of said wall.

14. The pair of blocks as recited in claim 13, wherein said channel is substantially v-shaped.

15. The pair of blocks as recited in claim 10, wherein said front face defines a projecting contour surface, whereby said block simulates the appearance of hand-hewn stone blocks.

16. The pair of blocks as recited in claim 15, wherein said contour surface is recessed from opposing side edges of said front face and from an upper edge of said front face, whereby said recess define gaps which simulate a mortar joint between adjacent ones of said blocks.

17. A low-rise decorative wall for landscape ornamentation, comprising:

a first tier of blocks placed side-by-side whereby at least each side edge of a front face of each block contacts a side edge of said adjacent block;

a second tier of blocks placed side-by-side on an upper surface of said first tier of blocks, said blocks in said second tier offset relative to said blocks in said first tier whereby said side edges of said blocks in said second tier are aligned medial said side edges of a pair of blocks in said first tier;

each of said blocks defining a bottom surface and an opposing top surface, a front face and an opposing back face, and two opposing sides that each define side faces between said front face and said back face;

said top surface defining a dished recessed cavity for receiving an adhesive and having an alignment point;

said block further defining a bore extending therethrough and open at said top surface and said bottom surface, said bore defining a longitudinal axis therein; and said alignment point of said recessed cavity and said longitudinal axis being substantially equally spaced from a front edge of said top surface and substantially equally spaced laterally from a substantially perpendicular line bisecting said front face, whereby said longitudinal axis of said bores of said blocks positioned in said second course substantially align with respective alignment points of said recessed cavities of said blocks in said first course, said bore for receiving an adhesive which fills said aligned recessed cavity and at least a portion of said bore, said adhesive being curable to define rivets in situ interconnecting said blocks in said second course and said blocks in said first course.

18. The low-rise decorative wall as recited in claim 17, wherein said tiers of blocks include at least one pair of adjacent blocks, said first one block of said pair of blocks having opposing sides that diverge outwardly from said front face to said back face at an obtuse angle relative to said front face and said second block of said pair of blocks has opposing sides that converge inwardly from said front face to said back face at an acute angle relative to said front face of said second block.

19. The low-rise decorative wall as recited in claim 18, wherein said converging and diverging side walls define supplementary angles relative to said front face.

20. The low-rise decorative wall as recited in claim 17, wherein said top surface of said first one block of said pair of blocks further defines a channel extending from a back edge to said front edge along said line bisecting said front face, whereby said channel defines a guide for dividing said block into halves to provide a one half block that matingly stacks in said course at a respective end thereof for defining a substantially planer end face or corner of said wall.

21. The low-rise decorative wall block as recited in claim 20, wherein said channel in said block is substantially v-shaped.

22. The low-rise decorative wall as recited in claim 17, wherein said recessed cavity in each respective block is circular.

23. The low-rise decorative wall block as recited in claim 17, wherein said front face of each block defines a projecting contoured surface, whereby said blocks simulate the appearance of hand-hewn stone blocks.

24. The low-rise decorative wall as recited in claim 23, wherein said contoured surface is recessed from opposing side edges of said front face and from an upper edge of said front face, whereby said recess define gaps which simulate a mortar joint between adjacent ones of said blocks.

25. The low-rise decorative wall as recited in claim 17, wherein said bore defines a first portion having a first diameter and a second portion having a second smaller diameter in a lower portion of said block, whereby a transition between said first portion and said second portion defines a stop for a nozzle of a tube of adhesive received therein for filling said recessed cavity and at least a portion of said bore with said adhesive.

26. A low-rise decorative wall for landscape ornamentation assembled from a plurality of pairs of blocks aligned side-by-side in tiers to a predetermined height for the wall, comprising:

a first tier of pairs of blocks placed side-by-side whereby at least each side edge of a front face of each block contacts a side edge of said adjacent block;

a second tier of pairs of blocks placed side-by-side on an upper surface of said first tier of blocks, said blocks in said second tier offset relative to said blocks in said first tier whereby said side edges of said blocks in said second tier are aligned medial said side edges of said blocks in said vertically lower first tier;

each of said blocks in said pair of blocks defining a body having a bottom surface and an opposing top surface, a front face and an opposing back face, and two opposing sides that each define side faces between said front face and said back face, said top surface defines a dished recessed cavity for receiving an adhesive and having an alignment point, said block further defines a bore extending therethrough and open at said top surface and said bottom surface, said bore defining a longitudinal axis therein, and said alignment point of said recessed cavity and said longitudinal axis being substantially equally spaced from a front edge of said top surface and substantially equally spaced laterally from a line bisecting said front face, whereby said longitudinal axis of said bores of said blocks positioned in said second tier substantially align with respective alignment points of said recessed cavities of said blocks in said first tier, said bore for receiving the adhesive which fills said aligned recessed cavity and at least a portion of said bore, said adhesive being curable to define rivets in situ interconnecting said blocks in said second tier and said blocks in said first tier;

one block of said pair of blocks having opposing sides that diverge outwardly from said front face to said back face at an obtuse angle relative to said front face;

another block of said pair of blocks having opposing sides that converge inwardly from said front face to said back face at an acute angle relative to said front face; and said angles of divergence and convergence of said side walls being substantially supplementary, whereby said pairs of blocks, being positioned side-by-side in said courses of blocks to form a low-rise ornamental wall, define a substantially planar surface for the wall.

27. The low-rise decorative wall as recited in claim 26, wherein said top surface of at least one of said blocks further defines a channel extending from a back edge to said front edge along said line bisecting said front face, whereby said channel defines a guide for dividing said block into halves to provide a one half block that matingly stacks in said course at a respective end thereof for defining a substantially planer end face or corner of said wall.

28. The low-rise decorative wall block as recited in claim 27, wherein said channel in said block is substantially v-shaped.

29. The low-rise decorative wall as recited in claim 26, wherein said recessed cavity in each respective block is circular.

30. The low-rise decorative wall block as recited in claim 26, wherein said front face of each block defines a projecting contoured surface, whereby said blocks simulate the appearance of hand-hewn stone blocks.

31. The low-rise decorative wall as recited in claim 30, wherein said contoured surface is recessed from opposing side edges of said front face and from an upper edge of said front face, whereby said recess define gaps which simulate a mortar joint between adjacent ones of said blocks.

32. The low-rise decorative wall as recited in claim 26, wherein said bore defines a first portion having a first diameter and a second portion having a second smaller diameter in a lower portion of said block, whereby a transition between said first portion and said second portion defines a stop for a nozzle of a tube of adhesive received therein for filling said recessed cavity and at least a portion of said bore with said adhesive.

33. A method of assembling a low-rise ornamental wall from a plurality of blocks, comprising the steps of:

(a) placing a plurality of blocks side-by-side in a course of said blocks to define a first tier of a wall of said blocks, each of said blocks defining a bottom surface and an opposing top surface, a front face and an opposing back face, and two opposing sides that each define side faces between said front face and said back face, said top surface defining a dished recessed cavity for receiving an adhesive and having an alignment point, and each of said blocks further defining a bore extending therethrough and open at said top surface and said bottom surface, said bore defining a longitudinal axis therein, said alignment point of said recessed cavity and said longitudinal axis being substantially equally spaced from a front edge of said top surface and substantially equally spaced laterally from a line bisecting said front face;

(b) placing a plurality of said blocks side-by-side in a second course of said blocks to define a second tier in said wall of said blocks, said second tier of blocks being off-set substantially one-half width of a block, whereby said longitudinal axis of said bores of said blocks positioned in said second tier substantially align with respective alignment points of said recessed cavities of said blocks in said first tier; and (c) filling said aligned recessed cavities of said blocks in said first tier and at least a portion of said bores in said blocks in said second tier with adhesive, whereby said blocks in said first and second tiers are joined together, said adhesive being curable to define rivets in situ interconnecting said blocks in said first and second tiers.

34. Said method as recited in claim 33, wherein said step (c) comprises:

inserting a tube of an adhesive into one of said bores;

injecting said adhesive through said bore and into said recessed cavity aligned with said one of said bores, whereby said recessed cavity and at least a portion of said one of said bores is filled with adhesive;

curing said adhesive to form a rivet that connects said block having said recessed cavity in said first tier to said block having said bore in said second tier; and repeating said step (c) for each of said blocks in said second tier.

35. A method of assembling a low-rise ornamental wall from a plurality of pairs of blocks, comprising said steps of:

(a) placing a plurality of pairs of blocks side-by-side in a course of said blocks to define a first tier of a wall of said blocks, each of said blocks defining a bottom surface and an opposing top surface, a front face and an opposing back face, and two opposing sides that each define side faces between said front face and said back face, said top surface of each of said blocks defining a dished recessed cavity for receiving an adhesive and having an alignment point, each of said blocks defining a bore extending therethrough and open at said top surface and said bottom surface, said bore defining a longitudinal axis therein, said alignment point of said recessed cavity and said longitudinal axis being substantially equally spaced from a front edge of said top surface and substantially equally spaced laterally from a line bisecting said front face, whereby said longitudinal axis of said bores of said blocks positioned in a second tier substantially align with respective alignment points of said recessed cavities of said blocks in said first tier, a first block of said pair of blocks having opposing sides that diverge outwardly from said front face to said back face at an obtuse angle relative to said front face;

a second block of said pair of blocks having opposing sides that converge inwardly from said front face to said back face at an acute angle relative to said front face; and said angles of divergence and convergence of said side walls being substantially supplementary, whereby said pairs of blocks, being positioned side-by-side in said course of blocks, define a substantially planar surface for the wall;

(b) placing a plurality of pairs of said blocks side-by-side in a second course of said blocks to define the second tier in said wall of said blocks;

(c) repeating step (b) until a predetermined height is reached by a last of said courses; and (d) placing adhesive into at least a portion of each bore and the aligned recessed cavity, which adhesive cures to define rivets in situ interconnecting said blocks in said first and second tiers.

36. The method as recited in claim 35, wherein said step (d) comprises:

inserting a tube of an adhesive into one of said bores;

injecting said adhesive through said bore and into said recessed cavity aligned with said one of said bores, whereby said recessed cavity and at least a portion of said one of said bores is filled with adhesive;

curing said adhesive to form a rivet that connects said block having said recessed cavity in said first tier to said block having said bore in said second tier; and repeating said step (d) for each of said blocks in said second tier.

* * * * *

UNITED STATES PATENT AND TRADEMARK OFFICE

CERTIFICATE OF CORRECTION

| | |
|---|---|
| PATENT NO. : | 5,848,511 |
| DATED : | December 15, 1998 |
| INVENTOR(S) : | John Scales |

It is certified that error appears in the above-indentified patent and that said Letters Patent is hereby corrected as shown below:

In claim 10, line 14, change "acute" to --angle--.
In claim 21, line 1, delete "block".
In claim 23, line 1, delete "block".
In claim 28, line 1, delete "block".
In claim 30, line 1, delete "block".

Signed and Sealed this

Thirteenth Day of July, 1999

*Attest:*

*Attesting Officer*

Q. TODD DICKINSON

*Acting Commissioner of Patents and Trademarks*